United States Patent [19]

Abdulally et al.

[11] Patent Number: 4,920,924

[45] Date of Patent: May 1, 1990

[54] FLUIDIZED BED STEAM GENERATING SYSTEM INCLUDING A STEAM COOLED CYCLONE SEPARATOR

[75] Inventors: Iqbal F. Abdulally, Randolph; Alfred S. Touma, West Caldwell; Peter Bartkowiak, Denville, all of N.J.

[73] Assignee: Foster Wheeler Energy Corporation, Clinton, N.J.

[21] Appl. No.: 395,865

[22] Filed: Aug. 18, 1989

[51] Int. Cl.[5] ..... F22B 1/00

[52] U.S. Cl. ..... 122/4 D; 110/245; 110/216

[58] Field of Search ..... 122/4 D; 110/245, 216; 431/170, 7

[56] References Cited

U.S. PATENT DOCUMENTS

| | | | |
|---|---|---|---|
| 4,699,068 | 10/1987 | Engstrom | 122/4 D |
| 4,708,092 | 11/1987 | Engstrom | 110/245 |
| 4,732,113 | 3/1988 | Engstrom | 122/4 D |
| 4,755,134 | 7/1988 | Engstrom et al. | 110/245 |
| 4,813,380 | 3/1989 | Engstrom | 122/4 D |

*Primary Examiner*—Henry C. Yuen

*Attorney, Agent, or Firm*—Marvin A. Naigur; Warren B. Kice

[57] ABSTRACT

A fluidized bed stream generating system in which a cyclone separator is disposed between the furnace section and heat recovery area of a steam generating system. The walls of the cyclone separator are provided with tubes which receive fluid from the steam drum. The fluid is passed through the walls of the separator to cool same before being passed to the heat recovery area.

13 Claims, 3 Drawing Sheets

FLUIDIZED BED STEAM GENERATING SYSTEM INCLUDING A STEAM COOLED CYCLONE SEPARATOR

BACKGROUND OF THE INVENTION

This invention relates to a fluidized bed steam generating system and, more particularly, to such a system in which a cyclone separator is provided and is cooled by steam generated in the system.

Fluidized bed combustion systems are well known. In these arrangements, air is passed through a bed of particulate material, including a fossil fuel such as coal and an adsorbent for the sulfur released as a result of combustion of the coal, to fluidize the bed and to promote the combustion of the fuel at a relatively low temperature. Water is passed in a heat exchange relationship to the fluidized bed to generate steam. The combustion system includes a separator which separates the entrained particulate solids from the gases from the fluidized bed in the furnace section and recycles them back into the bed. This results in an attractive combination of high combustion efficiency, high sulfur adsorption, low nitrogen oxides emissions and fuel flexibility.

The most typical fluidized bed utilized in the furnace section of these type systems is commonly referred to as a "bubbling" fluidized bed in which the bed of particulate material has a relatively high density and a well-defined, or discrete, upper surface. Other types of fluidized beds utilize a "circulating" fluidized bed. According to this technique, the fluidized bed density may be below that of a typical bubbling fluidized bed, the air velocity is equal to or greater than that of a bubbling bed, and the flue gases passing through the bed entrain a substantial amount of the fine particulate solids to the extent that they are substantially saturated therewith.

Also, circulating fluidized beds are characterized by relatively high solids recycling which makes it insensitive to fuel heat release patterns, thus minimizing temperature variations, and therefore, stabilizing the emissions at a low level. The high solids recycling improves the efficiency of the mechanical device used to separate the gas from the solids for solids recycle, and the resulting increase in sulfur adsorbent and fuel residence times reduces the adsorbent and fuel consumption.

However, several problems exist in connection with these type of fluidized systems. For example, it is often necessary to add expensive cooling surfaces for superheating the steam generated in the boiler. Also, difficulties arise in controlling the temperature range of the steam generated in the system. Further, these types of beds are used in systems, such as steam generators, which include one or more cyclone separators normally provided with a hopper connected to their lower end to collect the solid particles from the separator. The separator and the hopper are usually provided with a monolithic external refractory wall which is abrasion resistant and insulative so that the outer casing runs relatively cool. However, in order to achieve proper insulation, these walls must be relatively thick which adds to the bulk, weight, and cost of the separator and hopper and require controlled, relatively long, start-up and shut down times to prevent cracking of the refractory. Also, the outside metal casing of these designs cannot be further insulated from the outside since to do so could raise its temperature as high as 1500° F. which is far in excess of the maximum temperature it can tolerate. Still further, conventional separators installed in the above manner require a relatively long time to heat up before going online to eliminate premature cracking of the refractory walls, which is inconvenient and adds to the cost of the process.

Still further, systems utilizing a fluidized bed and a cyclone separator require relatively expensive, high temperature, refractory-lined ductwork and expansion joints between the fluidized bed furnace and the separator, and between the cyclone and a heat recovery section, which are fairly sophisticated and expensive.

SUMMARY OF THE INVENTION

It is therefore an object of the present invention to provide a steam generating system utilizing a fluidized bed boiler which overcomes the aforementioned disadvantages of previous systems.

It is a further object of the present invention to provide a system of the above type which eliminates the need for separate superheating surfaces.

It is a further object of the present invention to provide a system of the above type which permits improved control of the temperature range of the fluid being heated.

It is a still further object of the present invention to provide a system of the above type in which the exterior surface of the cyclone separator is maintained relatively stable and cool.

It is a still further object of the present invention to provide a system of the above type in which heat losses are reduced and the requirement for internal refractory insulation is minimized.

It is a still further object of the present invention to provide a system of the above type in which the bulk, weight and cost of the cyclone separator are much less than that of conventional separators.

It is a still further object of the present invention to provide a system of the above type in which the need for expensive, high-temperature, refractory-lined ductwork and expansion joints between the furnace and the cyclone separator and between the latter and the heat recovery section are minimized.

It is a still further object of the present invention to provide a system of the above type which permits relatively quick start-up and load changes.

Toward the fulfillment of these and other objects, according to the present invention, a cyclone separator is disposed between the furnace section and heat recovery area of a steam generating system. The walls of the cyclone separator are provided with tubes which receive steam from the steam drum. The steam is passed through the walls of the separator to cool same before being passed to the heat recovery area. The flue gases generated in the furnace section along with particulate material entrained thereby are passed to the cyclone separator for separation. The separated particulate material is recycled back to the furnace section and the separated gases are passed to the heat recovery area.

BRIEF DESCRIPTION OF THE DRAWINGS

The above brief description, as well as further objects, features and advantages of the present invention will be more fully appreciated by reference to the following detailed description of the presently preferred but nonetheless illustrative embodiments in accordance with the present invention when taken in conjunction with the accompanying drawing wherein.

DESCRIPTION OF THE PREFERRED EMBODIMENT

Figure 1:
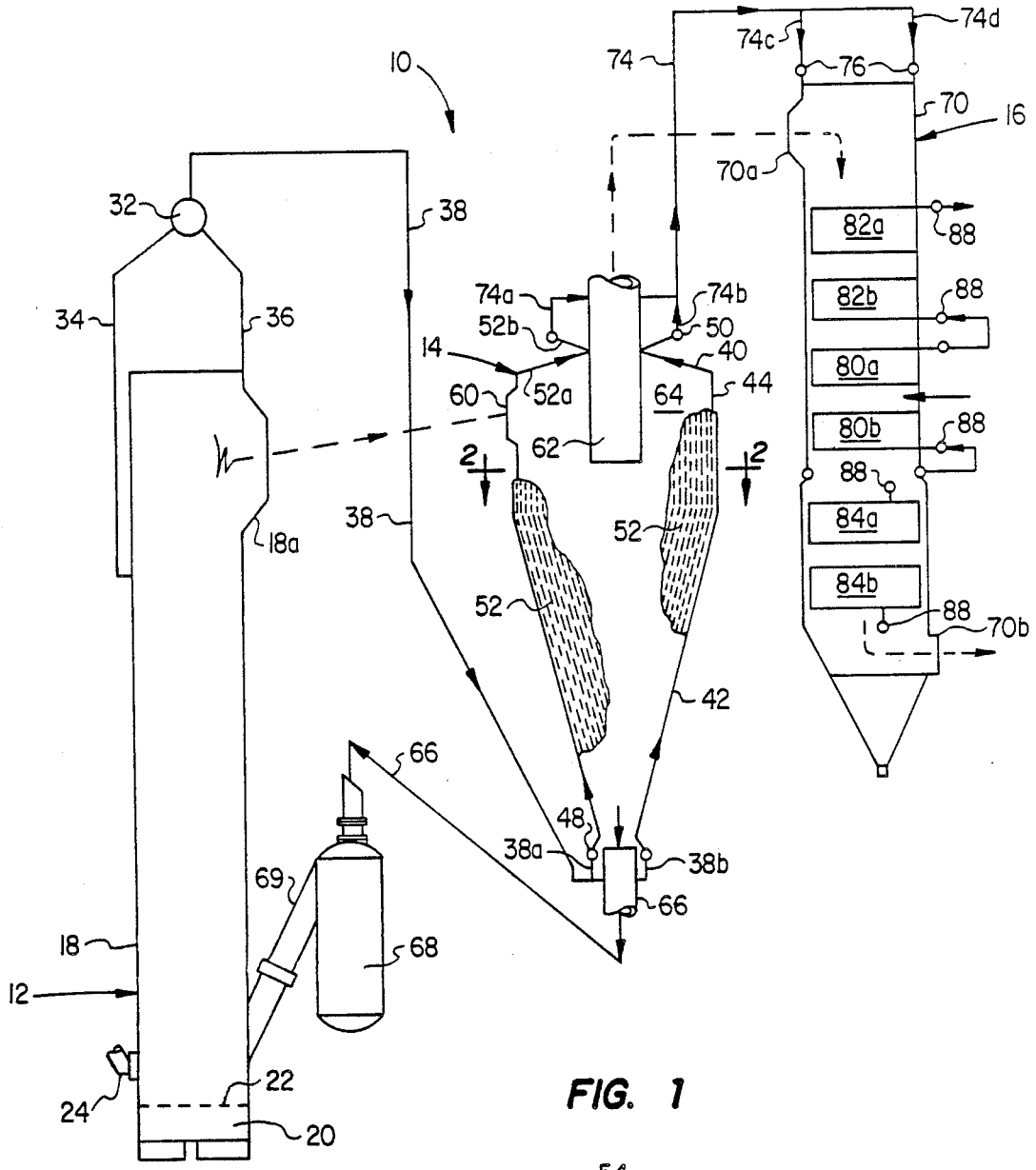
FIG. 1 is a schematic representation depicting the system of the present invention.

Referring specifically to FIG. 1 of the drawings, the reference numeral 10 refers, in general, to the fluidized bed combustion system of the present invention which includes a furnace section 12, a cyclone separator 14, and a heat recovery section 16. The furnace section 12 includes an upright enclosure 18 and an air plenum 20 disposed at the lower end portion of the enclosure for receiving air from an external source. An air distributor, or grate, 22 is provided at the interface between the lower end of the enclosure 18 and the air plenum 20 for allowing the pressurized air from the plenum to pass upwardly through the enclosure 18. The tubes forming the upper portion of the rear wall of the enclosure 18 are bent out of the plane of the wall to form an outlet 18*a* for flue gases and entrained particulate material, as will be described.

One or more inlets 24 are provided through the walls of the enclosure 18 for introducing a particulate material into the enclosure. The particulate material can include coal and relatively fine particles of an adsorbent material, such as limestone, for adsorbing the sulfur generated during the combustion of the coal, in a known manner. The air from the plenum 20 fluidizes the particulate material, as will be described. It is understood that a drain pipe registers with an opening in the air distributor 22 and/or walls of the enclosure 18 for discharging spent particulate material from the enclosure.

The walls of the enclosure 18 are formed by a plurality of tubes disposed in a vertically extending spaced, parallel relationship and connected by continuous fins (not shown) extending from diametrically opposed portions of each tube and are welded between adjacent tubes to form a gas tight structure. Since this construction is conventional, the walls will not be described in any further detail.

Flow circuitry is provided to pass water, steam and/or a water-steam mixture (hereinafter termed "fluid") through the tubes to heat the fluid to an extent that it can be used to perform work such as, for example, drive a steam turbine. To this end, headers, which are not shown for the convenience of presentation, are provided at the upper and lower ends of the walls forming the enclosure 18 for introducing fluid to, and receiving fluid from, the tubes forming the respective walls. A natural circulation steam drum 32 is connected by conduits 34 and 36 and other conduits and headers which are not shown, to the walls of the enclosure 18 to establish a fluid flow circuit as will be described. This flow circuit includes a downcomer 38 connector the upper section of the steam drums 32 to the cyclone separator 14.

The cyclone separator 14 may include an upper roof section 40, a conically-shaped lower hopper section 42 and an intermediate cylindrical section 44. A lower ring header 48 is disposed at the lower end of the hopper section 42 and an upper ring header 50 is disposed above the roof section 40.

Each of the sections 40, 42 and 46 are formed by a group of continuous, spaced, parallel tubes 52 spanning the entire length of the separator 14 and connected at their lower ends to the header 48 and at their upper ends to the header 50. As better shown in FIG. 2, the tubes 52 are spaced apart and a continuous fin 54 extends from diametrically opposed portions of each tube and is welded between adjacent tubes. The structure thus formed is disposed between an inner refractory material 56 and outer insulative material 58. The refractory material 56 can be a relatively thin layer of high conductivity refractory and the insulative material 58 may be of any conventional design.

An inlet 60 is provided to the interior of the cylindrical section 44 and can be formed by bending a portion of the tubes 52 out of the plane of the cylindrical section as shown in more detail in U.S. Pat. No. 4,746,337 assigned to the assignee of the present invention, the disclosure of which is incorporated by reference.

The hopper section 42 is formed by bending the tubes 52 radially inwardly from the intermediate section 44, and the roof section 40 is formed by bending the tubes 52 radially inwardly at an angle, as shown by the reference numeral 52*a*, and then upwardly at an angle, as shown by the reference numeral 52*b*.

An inner pipe, or cylinder 62 is disposed within the cylindrical section 44, is formed from a solid, metallic material, such as stainless steel, and has an upper end portion extending slightly above the roof section 40. The pipe 62 extends immediately within the circular opening defined by the apex formed by the bent tube portions 52*a* and 52*b*. An annular chamber 64 is formed between the outer surface of the pipe 62 and the inner surface of the cylindrical section 44, for reasons that will be described.

A discharge pipe 66 extends from the lower end of the hopper section 42 and is connected to a seal pot 68 which, in turn, is connected to the rear wall of the enclosure 18 by a pipe 69. The pipe 69 registers with an opening formed in the rear wall of the enclosure 18 for introducing recycled particulate material from the separator 14 back into the enclosure as will be described.

The steam drum 32 is connected, via the downcomer 38, and branch pipes, 38*a* and 38*b*, to the lower ring header 48. The fluid from the steam drum 32 is thus conveyed by the downcomer 38 to the pipes 38*a* and 38*b* by gravity and passes upwardly from the latter pipes to the ring header 48 and through the tubes 52 of the separator 14 by natural convection.

Although not shown in the drawings for the convenience of presentation, it is understood that the outlet 18*a* of the furnace section 12 is connected, by a suitable gas channel, enclosure, or the like, to the inlet 60 of the separator 14. The flue gases and entrained particulate material from the enclosure 18 pass into the annular chamber 64 of the separator and the particulate material is disengaged from the flue gases due to the centrifugal forces created in the latter chamber in a conventional manner. The separated flue gases rise in the separator 14 by convection and discharge from the pipe 62. Although not shown in the drawings for the convenience of presentation, it is understood that suitable ducting or the like connects the pipe 62 of the separator 14 to an inlet formed in the upper portion of the heat recovery section as will be described.

The heat recovery section 16 includes an enclosure 70, the walls of which are formed by a plurality of tubes connected in the same manner as described in connection with the walls of the enclosure 18. The upper and lower ends of the walls forming the heat recovery area are connected to the above-mentioned fluid flow circuitry including the steam drum 32. For example, a conduit 74 is connected to the upper ring header 50 of the separator 14 by branch conduits 74*a* and 74. Two headers 76 are disposed at the upper ends of the front and rear walls, respectively of the heat recovery section 16, and are connected to the conduit 74 by branch conduits 74*c* and 74*d*, respectively.

A pair of primary superheaters 80*a* and 80*b*, finish superheaters 82*a* and 82*b* and economizers 84*a* and 84*b*, all of which are formed by a plurality of bundles of heat exchange tubes, are disposed in the enclosure 70 and all are connected to headers 88. It is understood that the headers 88 are connected to the aforementioned fluid flow circuitry including the steam drum 32 and/or to a steam turbine, or both.

The tubes forming the upper end portion of the front wall of the enclosure are bent out of the plane of the wall to form an inlet 70*a* for receiving the gases from the pipe 62 of the separator 14.

These gases thus pass into the enclosure 70 as shown by the dashed lines in FIG. 1. In the enclosure 70 the gases pass in succession through the superheaters 80*a*, 80*b*, 82*a* and 82*b* and the economizers 84*a* and 84*b*. An outlet 70*b* is formed in the rear wall of the enclosure 70 for discharging the gases as also shown by the dashed lines.

The separated solids from the separator 14 pass from the hopper section 42 of the separator into and through the discharge pipe 66 before passing through the seal pot 68 and the pipe 69 for injection into the enclosure 18.

In operation, particulate fuel material from the inlet 24 is introduced into the enclosure 18 and adsorbent material can also be introduced in a similar manner, as needed. Pressurized air from an external source passes into and through the air plenum 20, through the air distributor 22 and into enclosure 18 to fluidize the material.

A lightoff burner (not shown), or the like, is provided to ignite the particulate fuel material. When the temperature of the material reaches an acceptably high level, additional fuel from the inlet 24 is discharged into the enclosure 18.

The material in the enclosure 18 is combusted or gasified by the heat in the furnace section 12 and the mixture of air and gaseous products of combustion (hereinafter referred to as "flue gases") passes upwardly through the enclosure 18 and entrain, or elutriate, the relatively fine particulate material in the enclosure. The velocity of the air introduced, via the air plenum 20, through the air distributor 22 and into the interior of the enclosure 18 is established in accordance with the size of the particulate material in the enclosure 18 so that a circulating fluidized bed is formed, i.e. the particulate material is fluidized to an extent that substantial entrainment or elutriation of the particulate material in the bed is achieved. Thus the flue gases passing into the upper portion of the enclosure 18 are substantially saturated with the particulate material.

The saturated flue gases pass to the upper portion of the enclosure 18 and exit through the outlet 18*a* and then pass through ducting (not shown) to the inlet 60 of the separator 14 as shown by the dashed lines in FIG. 1. The inlet 60 is arranged so that the flue gases containing the particulate material enter in a direction substantially tangential to the chamber 64 and thus swirl around in the chamber. The entrained solid particles are thus propelled, by centrifugal forces, against the inner wall of the cylindrical section 44 where they collect and fall downwardly by gravity into the hopper section 42.

The relatively clean gases remaining in the chamber 64 are prevented from flowing upwardly by the roof section 40, and thus enter the pipe 62 through its lower end. The gases pass through the length of the pipe 62 before exiting from the upper end of the pipe. The gases then pass through ducting (not shown) to the inlet 70*a* of the heat recovery section 16 and then pass downwardly through the length of the enclosure 70 and across the superheaters 80*a*, 805, 82*a* and 82*b* and the economizers 84*a* and 84*b* before exiting, via the outlet 70*b*, to external equipment.

The fluid accumulating in the steam drum 32 separates into liquid and steam with the relative hot fluid, or steam, rising to the upper portion of the drum by natural convection and the relatively cool fluid, or liquid, falling to the lower portion of the drum. The steam from the upper portion of the drum 32 is passed, via the pipes 38, 38*a* and 38*b* into the lower ring header 48 of the separator 14, and passes, by convection, upwardly through the tubes 52 in parallel. Since the steam is at a temperature less than the temperature of the separator 14 and, more particularly, the flue gases in the separator, the temperature of the separator is reduced. The steam is collected in the upper header 50 and passes, via the pipes 74, 74*a*, 74*b*, 74*c*, and 74*d*, to the headers 76 of the heat recovery section 16. The steam passes downwardly through the length of the walls forming the enclosure 70 to lower headers (not shown) which are connected to the flow circuitry including the steam drum 32.

The separated particulate material in the separator passes through the hopper section 42, the pipe 66 and the seal pot 68 before it is injected, via the pipe 69, back into the circulating fluidized bed in the enclosure 18. The steam from the drum thus passes downwardly to lower end of the separator 14 and upwardly, in parallel through the tubes 52 before passing to the heat recovery section 16.

Figure 2:
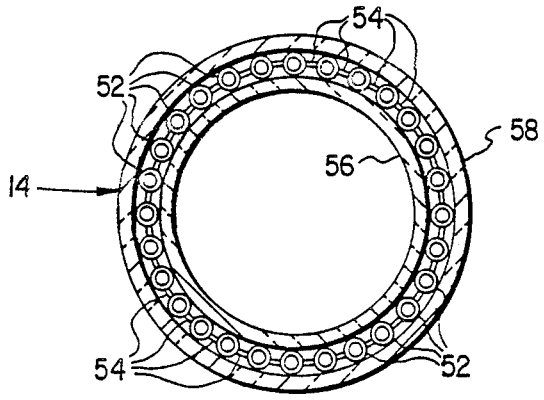
FIG. 2 is a cross-sectional view taken along the line 2—2 of FIG. 1.
Figure 3:
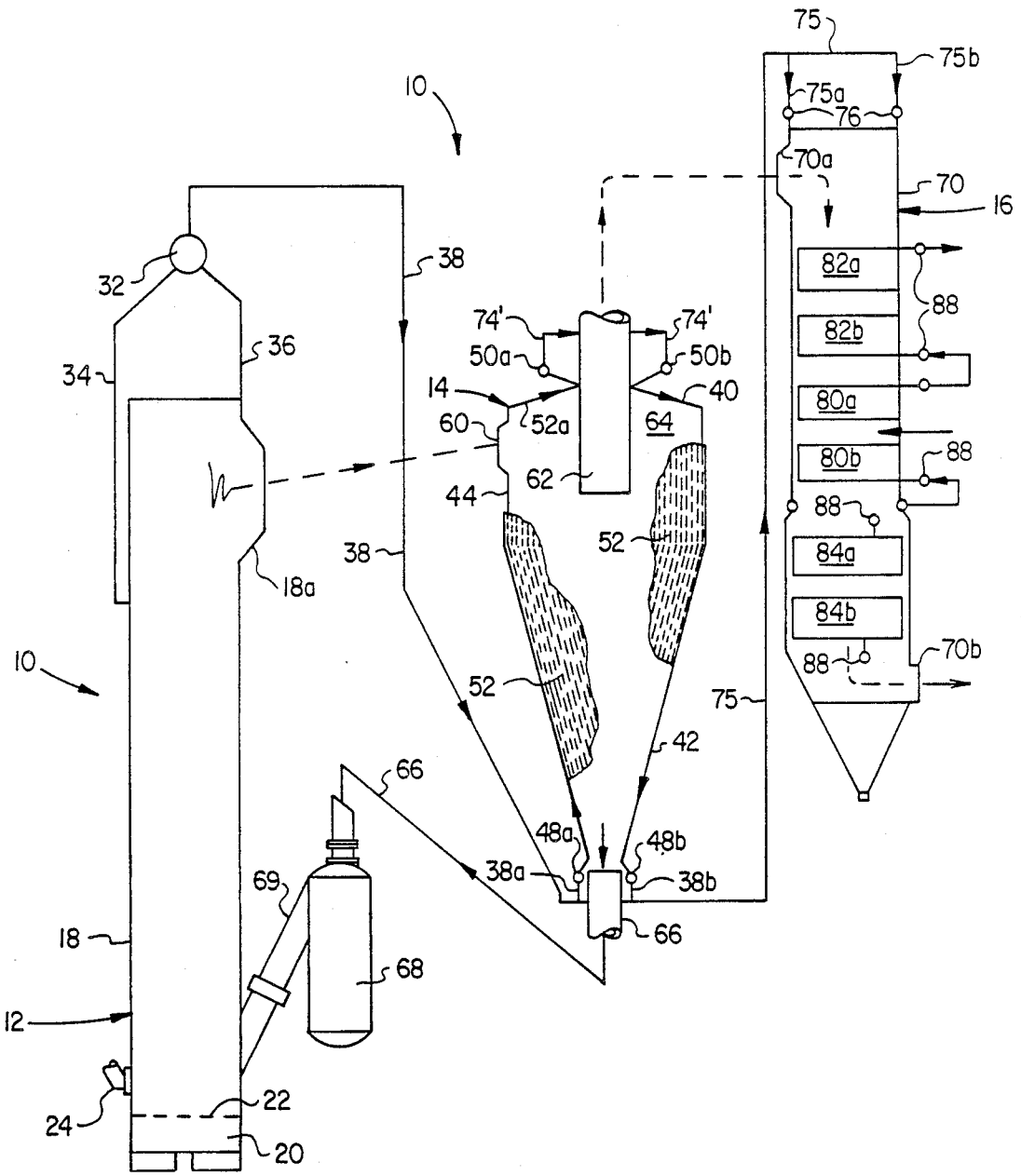
FIGS. 3 and 4 are views similar to FIG. 1, but depicting alternate embodiments of the present invention.
Figure 4:
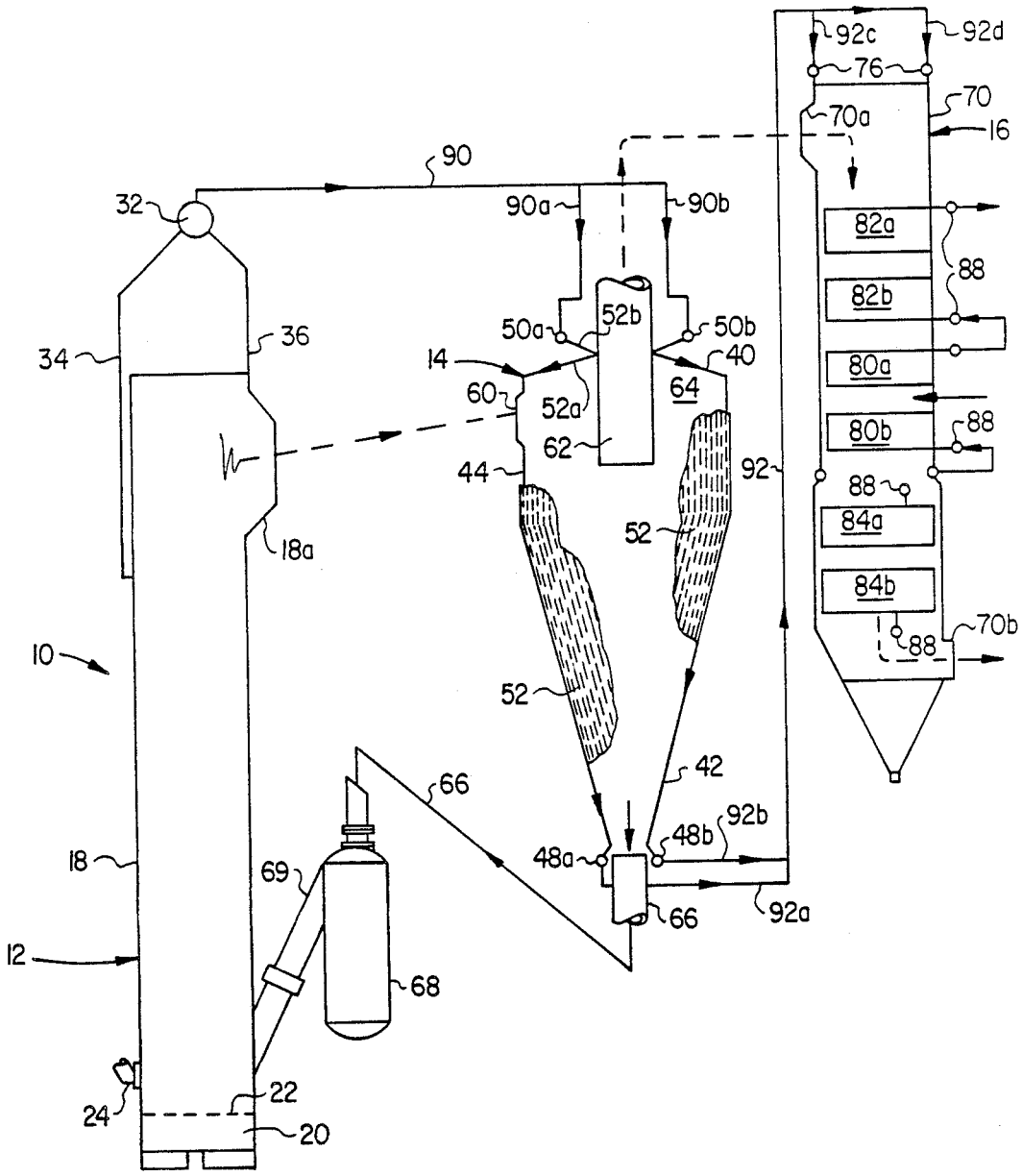

The embodiments of FIGS. 3 and 4 are similar to the embodiment of FIGS. 1 and 2 and contain identical components which are referred to by the same reference numbers. In the embodiment of FIG. 3, the ring header located at the lower portion of the separator 14 is divided into two separate sections 48*a* and 48*b*. Steam passes from the upper portion of the steam drum 32 downwardly through the downcomer 38 and then upwardly through the branch conduit 38*a* to the ring header section 48*a*. From the latter section, the steam passes upwardly through the tubes 52 forming approximately the left side of the separator 14 as viewed in FIG. 3. The ring header at the upper portion of the separator 14 is divided into two separate sections 50*a* and 50*b* connected by a conduit 74'. The ring header sections 50*a* and 50*b* are respectively connected to the tubes 52 forming the left side and the right side of the separator 14 so that the steam passing upwardly through the tubes 52 formed in the left side of the separator enters the ring header section 50*a* and passes, via the conduit 74', to the ring header section 50*b* before passing downwardly through the tubes 52 forming the right side of the separator 14. After passing downwardly through the latter tubes, this steam enters the lower ring header section 48*b* from which it passes to the branch conduit 38*b*. A riser pipe 75 is connected to the branch conduit 38*b*, and includes branch pipes 75*a* and 75*b* respectively connected to the headers 76 of the heat recovery section 16 for passing the steam through the walls of the enclosure 70 as described in connection with the previous embodiment.

Thus, according to the embodiment of FIG. 3, the steam passes downwardly to the lower portion of the separator 14, upwardly through a portion of the separator, then downwardly through another portion of the separator, then upwardly to the heat recovery section 16, and then downwardly through the latter section.

According to the embodiment of FIG. 4, two ring header sections 48*a* and 48*b* are provided in fluid flow communication with the lower ends of the tubes 52 of the separator 14 as described in connection with the previous embodiment, and two upper ring header sections 50*a* and 50*b* are provided in fluid flow communication with the upper ends of the latter tubes. According to the embodiment of FIG. 4, a conduit 90 extends from the upper portion of the steam drum 32 and is connected, via branch conduits 90*a* and 90*b*, to the ring header sections 50*a* and 50*b* respectively. A conduit 92 is connected, via branch conduits 92*a* and 92*b*, to the lower ring header sections 48*a* and 48*b*, respectively, and, via branch conduits 92*c* and 92*d*, respectively, to the headers 76 the heat recovery section 16.

According to the embodiment of FIG. 4, steam flows from the upper portion of the steam drum 32, via the conduit 90 and the branch conduits 90*a* and 90*b* to the upper ring header sections 50*a* and 50*b*, respectively. From the upper ring header section 50*a*, the steam flows downwardly through the tubes 52 forming the left hand portion of the separator 14, and from the upper ring header section 50*b* the steam flows downwardly through the tubes forming the right portion of the separator 14 as viewed in FIG. 4. The lower ring header sections 48*a* and 48*b* are respectively connected to the tubes 52 forming the left and right portions of the separator 14, and, in addition, are connected, via branch conduits 92*a* and 92*b* to the riser 92. The steam thus flows downwardly through the length of the separator 14 into the lower ring header sections 48*a* and 48*b* and through the branch conduits 92*a* and 92*b* before passing upwardly through the riser 92 to the headers 76 of the heat recovery section 16 via the branch conduits 92*c* and 92*d*.

Several advantages result from the system of the present invention. For example, the temperature of the separator 14 is reduced considerably due to the relatively cool fluid passing through its walls. Thus, heat losses from the separator 14 are reduced and the requirement for internal refractory insulation is minimized. Also, the bulk, weight, and cost of the separator 14 is much less than that of conventional separators, and start-up and load changes can be completed relatively quickly. Further, the need for expensive high temperature refractory-lined ductwork and expansion joints between the reactor and cyclone separator, and between the latter and the heat recovery section is minimized. Still further, superheating of the fluid is improved as well as the ability to control the temperature range thereof.

It is understood that variations in the foregoing can be made within the scope of the invention. For example, the inner pipe 62 of the separator 14 can be formed of tubes in a manner similar to the separator 14 and the latter tubes can be connected to the flow circuit including the steam drum 32. Also, while the ring headers 48 and 50 have been described and shown in the drawings, it should be understood that any other suitable header arrangement could be employed in connection with the present invention.

A latitude of modification, change and substitution is intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A fluidized bed steam generating system comprising:

(A) a furnace section comprising:
  (1) an enclosure containing solid particulate material including fuel; and
  (2) means for introducing air into said enclosure at a velocity sufficient to fluidize said particulate material and support combustion or gasification of said fuel to produce flue gases which rise in said enclosure and entrain a portion of said particulate material;

(B) a cyclone separator comprising:
  (1) an inner cylinder; and
  (2) an outer housing surrounding said inner cylinder for forming chamber, said outer housing comprising:
    (a) a plurality of parallel tubes; and
    (b) means connecting said tubes to form an air tight structure;

(C) a heat recovery section comprising:
  (1) an enclosure comprising:
    (a) a plurality of parallel tubes; and
    (b) means connecting said tubes to form an air tight structure;
  (2) a plurality of bundles of tubes disposed in said enclosure;

(D) means for passing said flue gases from said furnace section to said chamber for separating said entrained particulate material from said flue gases by centrifugal forces;

(E) means passing the separated particulate material from said separators back to said furnace section;

(F) means passing the separated flue gases to said heat recovery section; and (G) fluid flow circuit means comprising:
  (1) a steam drum;
  (2) means for connecting said steam drum to said tubes forming said outer housing of said separator for passing steam to said outer housing to cool said separator; and
  (3) means for connecting said tubes forming said outer housing to said tubes of said heat recovery section so that fluid passing through said latter tubes is heated by said separated flue gases.

2. The steam generating system of claim 1 wherein said cyclone separator comprises a cylindrical section, and a hopper and a roof respectively connected to the ends of said cylindrical section and formed by said tubes.

3. The steam generating system of claim 1 wherein said tubes forming said outer cylinder of said cyclone separator are spaced and wherein said outer cylinder further comprises a plurality of continuous fins extending for the length of said tubes and connected thereto to form an air tight structure.

4. The steam generating system of claim 1 wherein said means for connecting said steam drum to said tubes forming said outer housing of said separator comprises a first ring header connected in fluid flow communication with the lower ends of said tubes forming said outer housing of said separator, and a second ring header connected in fluid flow communication with the upper ends of said tubes forming said outer housing of said separator.

5. The steam generating system of claim 4 wherein said means for connecting said steam drum to said tubes forming said outer housing of said separator further comprises conduit means connecting said steam drum to said first ring header for passing steam upwardly through said latter tubes.

6. The steam generating system of claim 4 wherein said means for connecting said tubes of said outer housing of said separator to said tubes of said heat recovery section comprises conduit means connecting said second ring header to said tubes of said heat recovery section.

7. The steam generating system of claim 4 wherein said first ring header and said second ring header are each formed into two sections respectively connected to portions of said tubes forming said outer housing of said separator, and wherein said means for connecting said steam drum to said latter tubes further comprises conduit means connecting said steam drum to one section of said first ring header for passing steam upwardly through a portion of said latter tubes and to one section of said second ring header.

8. The steam generating system of claim 7 wherein said means for connecting said steam drum to said tubes forming said outer housing of said separator further comprises additional conduit means for connecting said one section of said second ring header to the other section thereof for passing said steam downwardly through the remaining portion of said latter tubes to the other section of said first ring header.

9. The steam generating system of claim 7 wherein said means for connecting said tubes of said outer housing of said separator to said tubes of said heat recovery section comprises conduit means connecting said other section of said second ring header to said tubes of said heat recovery section.

10. The steam generating system of claim 4 wherein said means for connecting said steam drum to said tubes forming said outer housing of said separator further comprises conduit means connecting said steam drum to said second ring header for passing steam downwardly through said latter tubes.

11. The steam generating system of claim 10 wherein said means for connecting said tubes of said outer housing of said separator to said tubes of said heat recovery section comprises conduit means connecting said first ring header to said tubes of said heat recovery section.

12. The steam generating system of claim 4 wherein said first ring header and said second ring header are each formed into two sections respectively connected to portions of said tubes forming said outer housing of said separator and wherein said means for connecting said steam drum to said latter tubes further comprises conduit means connecting said steam drum to each section of said second ring header for passing steam downwardly through said latter tubes and to each section of said first ring header.

13. The steam generating system of claim 12 wherein said means for connecting said tubes of said outer housing of said separator to said tubes of said heat recovery section comprises conduit means connecting said sections of said first ring header to said tubes of said heat recovery section.

* * * * *

US004920924B1

REEXAMINATION CERTIFICATE (2236th)

United States Patent [19] [11] B1 4,920,924

Abdulally et al. [45] Certificate Issued Mar. 1, 1994

[54] FLUIDIZED BED STEAM GENERATING SYSTEM INCLUDING A STEAM COOLED CYCLONE SEPARATOR

[75] Inventors: Iqbal F. Abdulally, Randolph; Alfred S. Touma, West Caldwell; Peter Bartkowiak, Denville, all of N.J.

[73] Assignee: Foster Wheeler Energy Corporation, Clinton, N.J.

Reexamination Request:
No. 90/002,795, Jul. 27, 1992

Reexamination Certificate for:

| | |
|---|---|
| Patent No.: | **4,920,924** |
| Issued: | **May 1, 1990** |
| Appl. No.: | **395,865** |
| Filed: | **Aug. 18, 1989** |

[51] Int. Cl.[5] ..... F22B 1/00
[52] U.S. Cl. ..... 122/4 D; 110/245; 110/216
[58] Field of Search ..... 122/4 D; 110/245, 216; 431/7, 170

[56] References Cited

U.S. PATENT DOCUMENTS

| | | | |
|---|---|---|---|
| 1,890,170 | 7/1925 | Van Brunt . | |
| 2,437,294 | 3/1948 | Dalin . | |
| 2,800,974 | 7/1957 | Gilman et al. . | |
| 2,937,141 | 5/1960 | Helwig . | |
| 2,995,807 | 8/1961 | Gibbs . | |
| 3,327,456 | 6/1967 | Guber et al. . | |
| 3,470,678 | 10/1969 | Clark et al. . | |
| 3,554,706 | 1/1971 | Henderson . | |
| 3,710,857 | 1/1973 | Meyer et al. . | |
| 3,732,920 | 5/1973 | Kimmel . | |
| 4,295,343 | 10/1981 | Izumi . | |
| 4,442,797 | 4/1984 | Strohmeyer, Jr. . | |
| 4,699,068 | 10/1987 | Engstrom | 122/4 D |
| 4,708,092 | 11/1987 | Engstrom | 110/245 |
| 4,713,098 | 12/1987 | Idvorian et al. . | |
| 4,732,113 | 3/1988 | Engstrom | 122/4 D |
| 4,746,337 | 5/1988 | Magol et al. . | |
| 4,755,134 | 7/1988 | Engstrom et al. | 110/245 |
| 4,813,380 | 3/1989 | Engstrom | 122/4 D |
| 4,880,450 | 11/1989 | Magol et al. . | |
| 4,904,286 | 2/1990 | Magol et al. . | |
| 4,913,711 | 4/1990 | Stewart . | |
| 4,944,250 | 7/1990 | Seshamani . | |
| 4,951,612 | 8/1990 | Gorzegno . | |

FOREIGN PATENT DOCUMENTS

| | | |
|---|---|---|
| 0298671 | 1/1989 | European Pat. Off. . |
| 437124 | 2/1985 | Sweden . |
| 581426 | 10/1946 | United Kingdom . |
| 587240 | 4/1947 | United Kingdom . |

*Primary Examiner*—Henry C. Yuen

[57] ABSTRACT

A fluidized bed stream generating system in which a cyclone separator is disposed between the furnace section and heat recovery area of a steam generating system. The walls of the cyclone separator are provided with tubes which receive fluid from the steam drum. The fluid is passed through the walls of the separator to cool same before being passed to the heat recovery area.

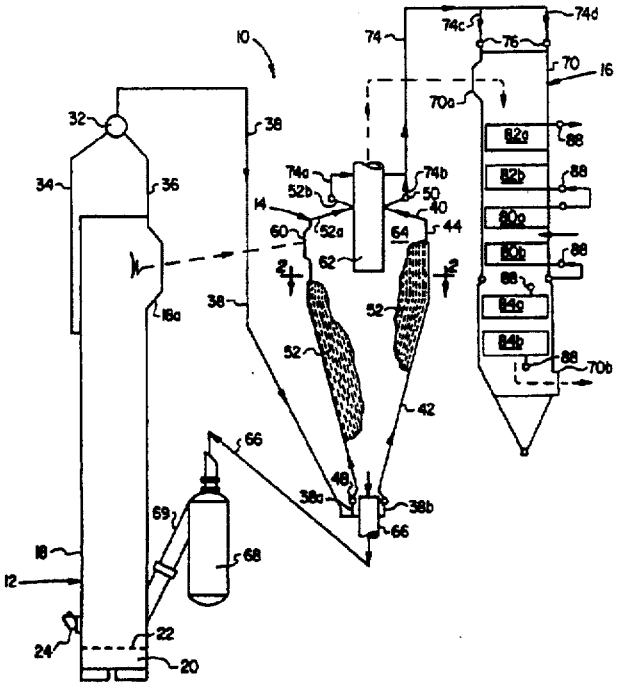

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 7–9, 12–13 is confirmed.

Claims 1–6, 10–11 are cancelled.

* * * * *